US005330169A

United States Patent [19]

Hawkes

[11] Patent Number: 5,330,169

[45] Date of Patent: Jul. 19, 1994

[54] APPARATUS AND METHOD FOR HANDLING SHEET MATERIAL ARTICLES

[75] Inventor: Richard B. Hawkes, Bethlehem, Pa.

[73] Assignee: AM International, Inc., Chicago, Ill.

[21] Appl. No.: 147,883

[22] Filed: Nov. 5, 1993

[51] Int. Cl.[5] ..... B65H 3/08

[52] U.S. Cl. ..... 271/101; 271/107; 271/112; 271/113; 271/119

[58] Field of Search ..... 271/99, 107, 112, 113, 271/119, 101

[56] References Cited

U.S. PATENT DOCUMENTS

| | | | |
|---|---|---|---|
| 2,797,092 | 6/1957 | Welsh | 271/113 X |
| 3,172,655 | 3/1965 | Lenk | 271/101 X |
| 3,319,541 | 5/1967 | Bereslavsky et al. . | |
| 3,650,525 | 3/1972 | Hageman et al. . | |
| 3,702,187 | 11/1972 | Hageman et al. . | |
| 4,405,122 | 9/1983 | Faltin . | |
| 5,174,559 | 12/1992 | Diamantides . | |

*Primary Examiner*—Richard A. Schacher
*Attorney, Agent, or Firm*—Tarolli, Sundheim & Covell

[57] ABSTRACT

An apparatus for use in handling sheet material articles includes a feed drum which is rotatable to sequentially pull sheet material articles from a hopper. A separator assembly includes a rotatable separator disk in which a plurality of gaps are formed. A plurality of suction applicator heads are rotatable with the separator disk relative to the hopper. Each of the suction applicator heads is aligned with a gap in the separator disk. During rotation of the separator disk and suction applicator heads together relative to the hopper, the suction applicator heads are operable to sequentially apply suction to lower side surfaces of lowermost sheet material article in the hopper. The feed drum pulls one sheet material article from the hopper while a next succeeding sheet material article in the hopper is engaged by a suction applicator head.

18 Claims, 3 Drawing Sheets

APPARATUS AND METHOD FOR HANDLING SHEET MATERIAL ARTICLES

BACKGROUND OF THE INVENTION

The present invention relates to an apparatus and method for use in handling sheet material articles and more specifically to an apparatus and method for feeding sheet material articles from a hopper.

Known devices for feeding sheet material articles from a hopper are disclosed in U.S. Pat. Nos. 3,650,525 and 3,702,187. These devices include a suction applicator head which is pivotally mounted beneath the hopper. The suction applicator head is movable to pull an edge portion of a lowermost sheet material article downwardly toward a rotating separator disk. The rotating separator disk engages the sheet material article and deflects it toward a feed drum. The feed drum pulls the sheet material article from the hopper and deposits the sheet material article onto a collator conveyor.

Due to the location of the suction applicator head relative to the hopper and the separator disk, the suction applicator head cannot be raised to engage a next succeeding sheet material article until the feed drum has pulled the preceding sheet material article past the suction applicator head. During rotation of a feed drum having a pair of grippers, as shown in U.S. Pat. No. 3,650,525, it takes about 30° of movement of the feed drum to raise the suction applicator head. About the same duration, that is, about 30°, is required for the suction applicator head to pull the sheet material article downward for engagement by the separator disk. A short 15° dwell time is provided to allow the suction applicator head to seal against the lower side of the sheet material article in the hopper. After the sheet material article has been pulled downward by the suction applicator head, the separator disk can enter over it to hold the sheet material article in position for engagement by grippers on the feed drum.

During movement of the suction applicator head into and out of engagement with a sheet material article, the portion of the feed drum circumference adjacent to the suction applicator head cannot be used to carry a sheet material article. The time required to move the suction applicator upward into engagement with the sheet material article, to seal against the lower side of the sheet material article, and to pull the sheet material article downward and for the separator disk to engage the sheet material article is a substantial portion of a revolution of the feed drum. This means that only a substantially reduced portion of the feed drum circumference can be used to carry a sheet material article.

It is desirable to have a sheet material article deposited on a raceway/track of a collator conveyor at a velocity and in a direction which matches the velocity and direction of movement of sheet material articles by the collator conveyor. In order to match the velocity between the feed drum and the collator conveyor, a track pusher chain division which is 30% to 40% greater than the signature length has been required. The distance by which a pusher chain division exceeds the signature length must be the same as the feed drum circumference which is required to accommodate movement of the suction applicator head.

In order to retain matched sheet material feed speeds by the feed drum and the collator conveyor, the timing of the collator conveyor and the feed drum becomes critical. This can result in an undesirable timing relationship between the feed drum and the collator conveyor, a large mismatch in the velocity at which sheet material is fed from the feed drum and the velocity at which feed material is moved by the collator conveyor, and/or a longer than desired distance between pusher chain centers on the collator conveyor.

SUMMARY OF THE INVENTION

An improved apparatus for handling sheet material articles includes a separator assembly which separates edge portions of sheet material articles disposed in a hopper. The separator assembly includes a rotatable separator disk. In accordance with one of the features of the invention, a plurality of suction applicator heads are rotated with the separator disk relative to the stack of sheet material articles in the hopper.

During operation of the apparatus to feed sheet material articles from the hopper, the separator assembly is operable to separate an edge portion of a sheet material article in the hopper while a preceding sheet material article is being pulled from the hopper by a feed conveyor. Thus, suction is applied to a lower side surface of a sheet material article in the hopper by a suction applicator head which is being rotated with the separator disk. At the same time, a preceding sheet material article is being pulled from the hopper by the feed conveyor.

BRIEF DESCRIPTION OF THE DRAWINGS

The foregoing and other features of the invention will become more apparent upon a consideration of the following description taken in connection with the accompanying drawings, wherein.

DESCRIPTION OF ONE SPECIFIC PREFERRED EMBODIMENT OF THE INVENTION

General Description

Figure 1:
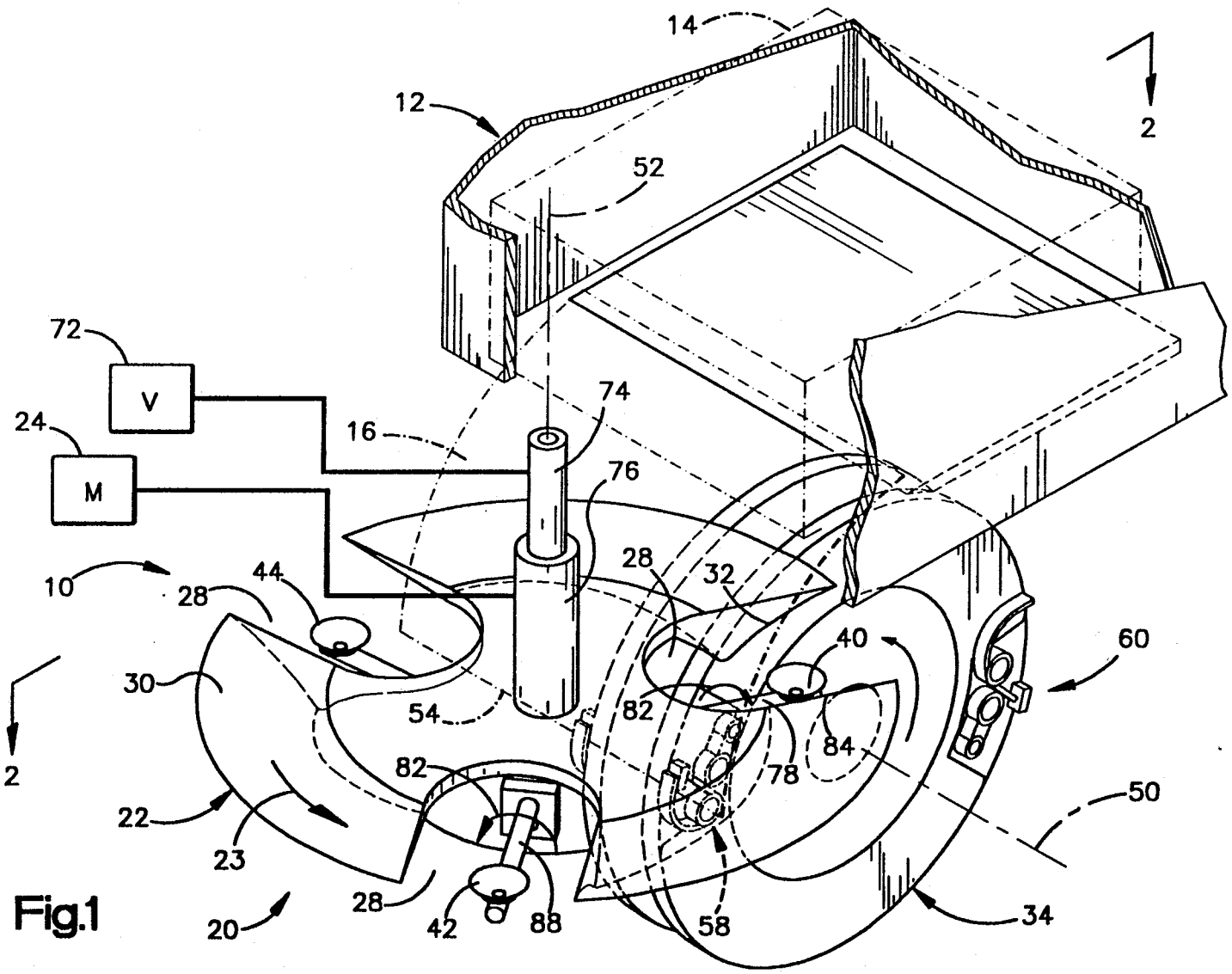
FIG. 1 is a schematic illustration of an apparatus which is constructed and operated in accordance with the present invention to handle sheet material articles.

An apparatus 10 for use in handling sheet material articles is illustrated schematically in FIG. 1. The apparatus 10 includes a rectangular hopper 12 (FIGS. 1, 3 and 4) which holds a stack 14 of rectangular sheet material articles 16. The sheet material articles 16 may be signatures, newspaper sections, individual sheets of material, or other sheet material items.

A separator assembly 20 is operable to separate an edge portion of a lowermost sheet material article 16 in the stack 14 of sheet material articles from the next succeeding material article in the stack of sheet material articles. The separator assembly 20 includes a circular disk 22 which is rotated, in the direction of the arrow 23, about a vertical axis by a drive motor 24 (FIG. 1).

The separator disk 22 has a plurality of gaps 28 which extend radially inwardly from a circular peripheral edge portion of the disk. The gaps 28 extend axially through the separator disk 22.

Figure 2:
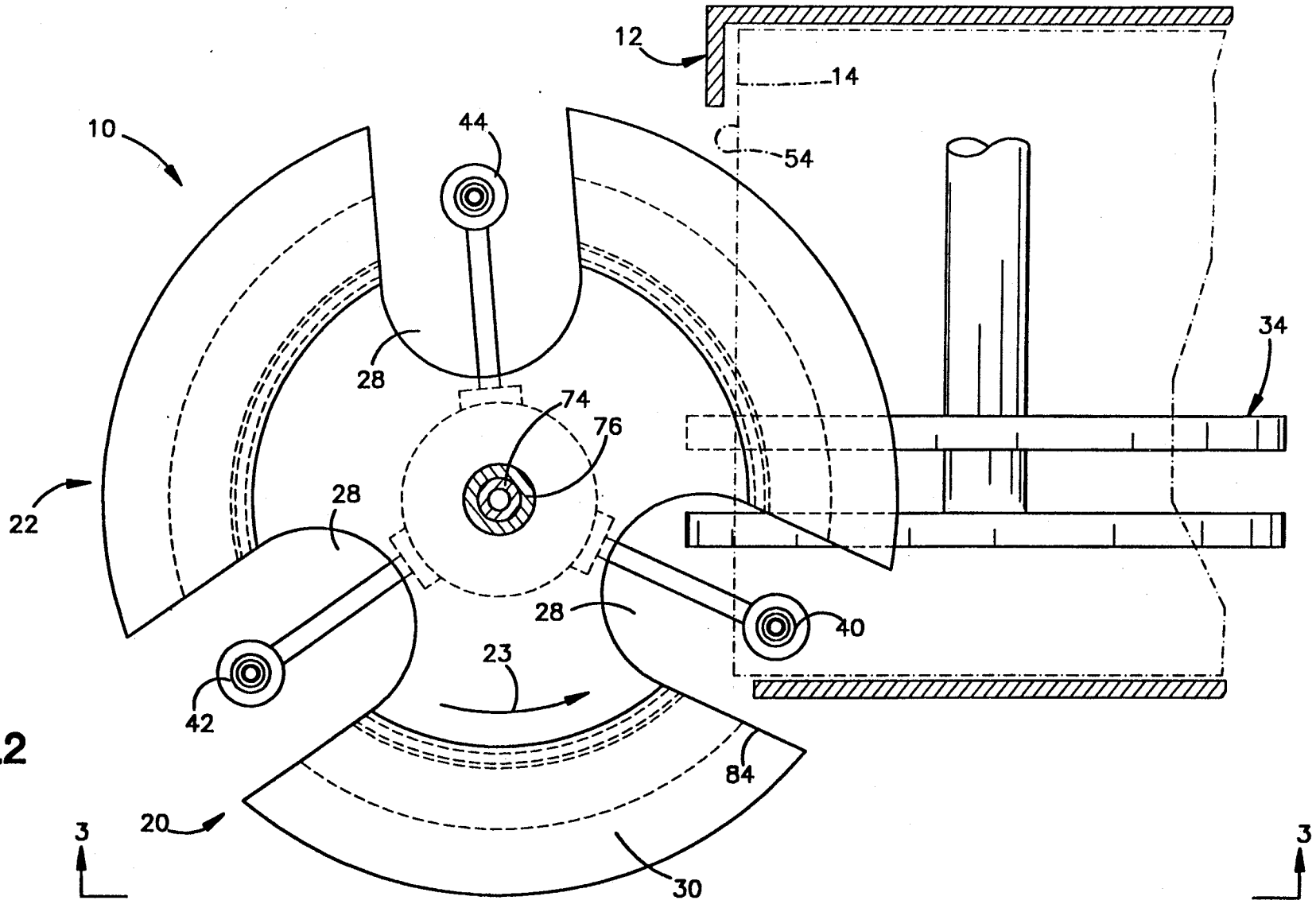
FIG. 2 is a schematic plan view, taken generally along the line 2—2 of FIG. 1, illustrating the relationship between a separator disk and a plurality of suction applicator heads which are rotated with the separator disk relative to a stack of sheet material articles in a hopper.
Figure 3:
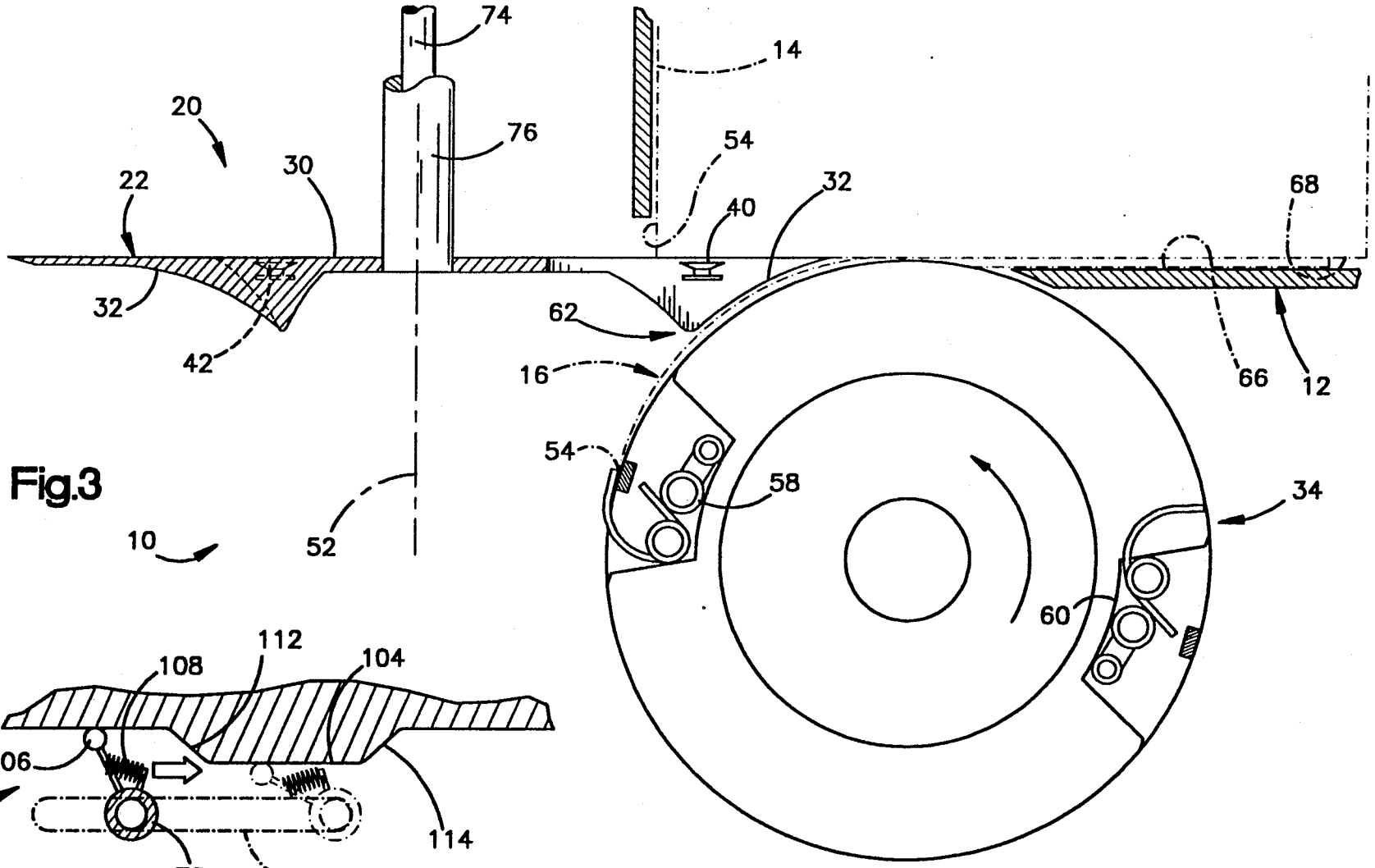
FIG. 3 is a schematic side elevational view, taken generally along the line 3—3 of FIG. 2, illustrating the relationship of the separator disk and suction applicator heads to a feed drum.

The separator disk 22 has a flat circular upper side surface 30 (FIGS. 1 and 2) which is slidable along a lower side surface of a sheet material article 16 in the stack 14 in the hopper 12 (FIG. 3). The disk 22 also has a plurality of cam surfaces 32 (FIG. 3) on a lower side of the disk. The cam surfaces 32 are sequentially engageable with upper side surfaces of sheet material articles 16 to deflect the sheet material articles downwardly toward a circular feed drum 34 of known construction.

A plurality of suction applicator heads 40, 42 and 44 (FIGS. 1 and 2) are operable to sequentially apply suction to a lower side surface of the sheet material article 16 in the stack 14. After a suction applicator head, for example, the suction applicator head 40, has gripped the lower side surface of a sheet material article, the suction head is moved downward relative to the separator disk 22. This deflects the engaged edge portion of a sheet material article 16 downward through a gap 28 in the separator disk 22.

The edge portion of the deflected sheet material article 16 is then engaged by a cam surface 32 on a lower side of the separator disk 22. Thus, after the edge portion of a sheet material article 16 has been deflected downward by the suction applicator head 40, continued rotation of the separator disk moves a cam surface 32 into engagement with the upper side surface of the sheet material article. The cam surface 32 further deflects the sheet material article 16 toward the feed drum 34.

The cylindrical feed drum 34 is rotatable about a horizontal axis 50 (FIG. 1). The feed drum axis 50 extends perpendicular to a vertical axis 52 about which the separator disk 22 is rotated. The axis 50 about which the feed drum 34 rotates extends parallel to front edge portions 54 of sheet material articles 16 in the stack 14 of sheet material articles.

The cylindrical feed drum 34 includes a plurality of gripper assemblies 58 and 60. The gripper assemblies 58 and 60 are disposed at equally spaced apart locations about the circumference of the feed drum 34. The gripper assemblies 58 and 60 are operable to sequentially grip the front or leading edge portion 54 of a sheet material article 16 at a pickup location 62 (FIG. 3).

As the gripper assembly 58 is moved to the pick up location 62, it is operated in a known manner to engage the front or leading edge portion 54 of a sheet material article 16 (FIG. 3). Continued rotation of the feed drum 34 in a counterclockwise direction, as viewed in FIG. 3, moves the front edge portion 54 of the gripped sheet material article 16 and gripper assembly 58 away from the pick up location 62. As the feed drum 34 continues to rotate, the gripper assembly 58 pulls the sheet material article 16 out of the hopper 12. As the sheet material article 16 is pulled from the hopper 12, an upper side surface 66 (FIG. 3) on the sheet material article slides along a downwardly facing lower side surface 68 on the next succeeding or lowermost sheet material article in the stack 14 of sheet material articles.

Continued rotation of the feed drum 34 in a counterclockwise direction (as viewed in FIG. 3) moves the gripper assembly 58 downwardly toward a collator conveyor. The collator conveyor may be a chain-type collator conveyor having the construction disclosed in U.S. Pat. No. 3,702,187 or in U.S. Pat. No. 5,174,559. Of course, if desired, the collator conveyor could have a different construction. It should also be understood that a sheet material conveyor having a construction which is substantially different than the construction of the feed drum 34 could be used to pull sheet material articles 16 from the hopper 12.

Separator Assembly

In accordance with a feature of the present invention, the suction applicator heads 40, 42 and 44 are rotated with the separator disk 22. Since the suction applicator heads 40, 42 and 44 are rotated with the separator disk 22, the suction applicator heads sequentially move into and out of the space between the feed drum 34 and the stack 14 of sheet material articles. This enables a sheet material article 16 to be transported by the feed drum 34 while the suction applicator head 40 moves into engagement with and grips the lower side surface of the lowermost sheet material article in the stack 14. Since the suction applicator head 40 can engage the lowermost sheet material article 16 in the stack 14 while the preceding sheet material article is being pulled from the stack by the feed drum 34, the speed at which sheet material articles can be fed from the stack is increased.

During movement of the separator disk 22 from the position shown in FIG. 1 to the position shown in FIG. 2, the suction applicator head 40 moves into a space located beneath the lowermost sheet material article 16 in the stack 14 and above a sheet material article being transported by the feed drum 34. When the suction applicator head 40 has moved beneath the stack 14, the suction applicator head 40 is connected with a source of vacuum or suction through a valve 72 and a stationary conduit 74.

The stationary conduit 74 is coaxial with a rotatable separator disk drive shaft 76. The separator disk 22 and suction applicator heads 40, 42 and 44 are connected with the separator disk drive shaft 76. The separator disk 22, suction applicator heads 40, 42 and 44, and separator disk drive shaft 76 are all rotated together about the vertical axis 52 by the motor 24. Therefore, the suction applicator heads 40, 42 and 44 move with the separator disk 22 relative to the hopper 12 and stack 14 of sheet material articles 16.

Rotation of the separator disk 22 and suction applicator head 40 moves a hollow support arm or conduit 78 connected with the suction applicator head 40 relative to a stationary vacuum manifold chamber. When the suction applicator head reaches the position shown in FIGS. 1 and 2, the hollow support arm 78 moves into alignment with an arcuate valve slot in a stationary wall of the vacuum manifold chamber. This enables the suction applicator head 40 to grip the lower side surface of the lowermost sheet material article in the stack 14.

Immediately after the lower side surface of the lowermost sheet material article in the stack 14 has been gripped by the suction applicator head 40, the hollow support arm 78 is rotated about its central axis in the manner indicated by the arrow 82 in FIG. 1. The suction applicator head 40 is rotated so as to move a corner portion of the lowermost sheet material article downward and in a direction opposite to the direction of rotation of the separator disk 22 and suction applicator head 40. This deflects the corner portion of the lowermost sheet material article downward and toward the left as the suction applicator head 40 and separator disk 22 continue to rotate.

Immediately after the corner portion of the lowermost sheet material article 16 in the hopper 12 has been deflected downward by the suction applicator head 40, the hollow support arm 78 moves out of alignment with the stationary valve slot leading to the vacuum manifold chamber. Therefore, the application of suction to the lower side of the sheet material article 16 is interrupted. This results in the corner portion of the lowermost sheet material article 16 being released by the suction applicator head 40. As this is occurring, the separator disk 22 and suction applicator head 40 continue to rotate together about the axis 52.

The continued rotation of the separator disk 22 moves a trailing edge portion of a gap 28 aligned with the suction applicator head 40 into the space between the downwardly deflected corner portion of the lowermost sheet material article 16 in the hopper 12 and the next succeeding sheet material article. At this time, the upper side surface 30 of the separator disk is in engagement with the lower side surface of the lowermost sheet material article to the left (as viewed in FIG. 1) of the gap 28 aligned with the suction applicator head 40. In addition, a lower side or cam surface 32 on the separator disk 22 is in engagement with the upper side surface of the lowermost sheet material article 16. Thus, the sheet material article 16 in the hopper 12 extends through the gap 28 with which the suction applicator head 40 is aligned. Since the hollow support arm 78 has moved out of alignment with the valve slot in the wall of the vacuum manifold chamber, the suction applicator head 40 is ineffective to grip the lower side of the sheet material article.

Figure 4:
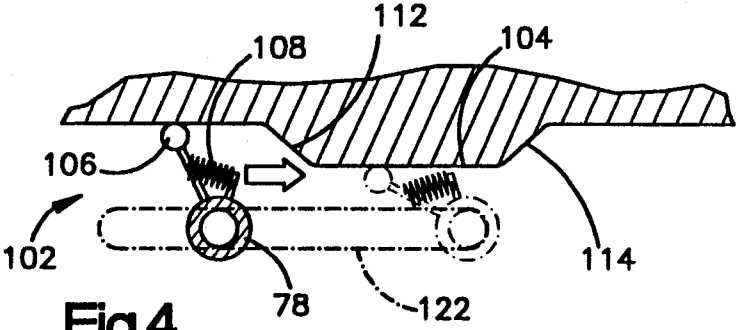
FIG. 4 is a highly schematicized illustration of an apparatus used to move a suction applicator head relative to the separator disk.

Continued rotation of the separator disk 22 and suction applicator heads 40, 42 and 44 moves the cam surface 32 on the lower portion of the separator disk along the upper side surface of the lowermost sheet material article 16 in the hopper 12. This further deflects the lowermost sheet material article 16 downward toward the pick up location 62 (FIG. 4). As this is occurring, the gripper assembly 60 on the feed drum 34 is moving toward the pick up location 62.

As the suction applicator head 40 moves clear of the downwardly deflected front edge portion 54 of the lowermost sheet material article 16 in the hopper 12, the gripper assembly 60 moves to the pick up location 62 and is in position to engage the front edge portion 54 of the sheet material article. The gripper assembly 60 is then operated to securely grip the front edge portion 54 of the sheet material article 16.

Continued rotation of the feed drum 34 pulls the sheet material article 16 part way out of the hopper 12 as the separator disk 22 and suction applicator heads 40, 42 and 44 continue to rotate together about the axis 52. This continued rotation of the separator disk 22 moves the next succeeding suction applicator head 42 beneath the front edge 54 of the next succeeding and what is now the lowermost sheet material article 16 in the hopper 12. The suction applicator head 42 then grips the lower side surface of the lowermost sheet material article 16. The suction applicator head 42 is then rotated about the central axis of the hollow support arm 88 to move the gripped front edge portion of the lowermost sheet material article downwardly through the gap 28 aligned with the suction applicator head 42. As the lowermost sheet material article 16 is being deflected by the suction applicator head 42 and moved through the gap 28 in the separator disk 22, the preceding sheet material article is still being pulled from the hopper 12 by the feed drum 34.

The application of suction to the lower side surface of the lowermost sheet material article 16 in the hopper 12 by the suction applicator head 42 is then interrupted. The trailing edge portion of the gap 28 aligned with the suction applicator head 42 moves into the space between the deflected front edge portion of the lowermost sheet material article 16 and the next succeeding sheet material article. Continued rotation of the separator disk 22 results in a cam surface 32 on the lower side of the separator disk forcing this sheet material article downwardly toward the pick up location 62.

As the lowermost sheet material article 16 in the stack 14 of sheet material articles is being gripped by the suction applicator head 42 and then deflected downwardly toward the pick up location 62 by the separator disk 22, the feed drum 34 is pulling the preceding sheet material article from the hopper 12. As the feed drum 34 rotates with the preceding sheet material article 16 firmly held by the gripper assembly 60, the upper side surface of the sheet material article slides along the lower side surface of the lowermost sheet material article in the stack 14. As the preceding sheet material article is released by the gripper assembly 50 and deposited onto a collator conveyor, the gripper assembly 50 is closed to grip the lowermost sheet material article at the pickup location 62.

Continued rotation of the separator disk 22 moves the suction applicator head 44 beneath the stack 14 of sheet material articles. The suction applicator head 44 then grips the lower side of what has become the lowermost sheet material article in the stack 14. The foregoing process of feeding sheet material articles is repeated during continued operation of the feed drum 34 and separator assembly 20.

Since the separator disk 22 and suction applicator heads 40, 42 and 44 rotate together about the axis 52, the suction applicator heads can move into engagement with a lowermost sheet material article in the hopper 12 while a preceding sheet material article is still being pulled from the hopper by the feed drum 34. This enables the rate at which sheet material articles 16 are fed from the hopper to be maximized. In addition, the space between the trailing end of one sheet material article 16 fed by the drum 34 and the leading end of the next succeeding sheet material article is minimized.

A drive assembly 102 for moving the suction applicator head 40 relative to the separator disk 22 when the suction applicator head has gripped the lower side of a sheet material article is illustrated schematically in FIG. 4. The drive assembly 102 includes a stationary cam 104. A cam follower 106 is connected with the hollow support arm 78 for the suction applicator head 40. A biasing spring 108 urges the cam follower 106 into engagement with the cam 104.

When the cam follower 106 moves into engagement with a rise 112 on the cam surface 104, the support arm 78 and suction applicator head 40 are rotated in a counterclockwise direction (as viewed in FIG. 4). This results in the suction applicator head 40 being rotated to move a gripped front edge portion of a sheet material article downwardly through a gap 28 in the separator disk 22.

As the separator disk 22 and suction applicator head 40 continue to rotate together relative to the stationary cam 104, the cam follower moves down a slope 114. As this occurs, the support arm 78 and suction applicator head 40 are rotated in a clockwise direction, as viewed in FIG. 4, relative to the separator disk 22. This moves the suction applicator head 40 back into position to engage the front edge portion of a next succeeding sheet material article.

Continued rotation of the separator disk 22 and suction applicator heads 40, 42 and 44 moves a drive assembly for the suction applicator head 42 relative to the stationary cam 104 to effect movement of the suction applicator head 42 relative to the separator disk 22. Similarly, continued rotation of the separator disk 22 and suction applicator heads 40, 42 and 44 moves the drive assembly for the suction applicator head 44 to the stationary cam 104 to effect movement of the suction head 44 relative to the separator disk 22. It should be understood that the suction applicator heads 40, 42 and 44 continue to rotate with the separator disk 22 about the axis 52 as the cam 104 sequentially rotates the suction applicator heads relative to the separator disk. Although a specific drive assembly 102 for sequentially moving the suction heads 40, 42, and 44 relative to the separator disk 22 has been illustrated schematically in FIG. 4, it should be understood that a drive assembly for moving the suction heads could have a different construction if desired.

A valve slot 122 in a stationary wall of the vacuum manifold chamber is illustrated schematically in FIG. 4. The hollow support arm 78 connected with the suction applicator head 40 moves into alignment with the valve slot 122 shortly before the cam follower 106 engages the rise 112 in the cam 104. This enables suction to be applied to a lower side of a sheet material article 16 in the hopper 12 before the suction applicator head 40 is rotated by the support arm 78.

As the cam follower 106 moves along the rise 112 in the cam 104, the suction applicator head 40 is connected with the vacuum manifold chamber through the valve slot 122. After the sheet material article 16 has been deflected through a gap 28 in the separator disc 22 by rotation of the suction applicator head 40, the support arm 78 moves out of alignment with the valve slot 122 and the valve slot is blocked. This interrupts the application of suction by the suction applicator head 40. The cam follower 106 then moves along the slope 114 to rotate the suction head 40 back to its original orientation.

In view of the foregoing description it is apparent that an improved apparatus 10 for handling sheet material articles includes a separator assembly 20 which separates edge portions 54 of sheet material articles 16 disposed in a hopper 12. The separator assembly 20 includes a rotatable separator disk 22. In accordance with one of the features of the invention, a plurality of suction applicator heads 40, 42 and 44 are rotated with the separator disk 22 relative to the stack 14 of sheet material articles 16 in the hopper 12.

During operation of the apparatus 10 to feed sheet material articles from the hopper, the separator assembly 20 is operable to separate an edge portion 54 of a sheet material article 16 in the hopper 12 while a preceding sheet material article is being pulled from the hopper by a feed conveyor 34. Thus, suction is applied to a lower side surface of a sheet material article 16 in the hopper 12 by a suction applicator head 40, 42 or 44 which is being rotated with the separator disk 22. At the same time, a preceding sheet material article 16 is being pulled from the hopper 12 by the feed conveyor 34.

Having described the invention, the following is claimed:

1. An apparatus for use in handling sheet material articles, said apparatus comprising hopper means for supporting a stack of sheet material articles, separator means for sequentially separating edge portions of sheet material articles from adjacent sheet material articles in the stack of sheet material articles in said hopper means, and feed means for sequentially feeding sheet material articles from said hopper means, said separator means including a rotatable separator disk having surface means for defining a plurality of gaps which extend through said separator disk, and a plurality of suction applicator heads which are rotatable with said separator disk relative to said hopper means, each of said suction applicator heads being aligned with a gap in said separator disk, each of said suction applicator heads including means for applying suction to a portion of a lowermost sheet material article in the stack of sheet material articles at the gap in said separator disk with which the suction applicator head is aligned.

2. An apparatus as set forth in claim 1 further including means for sequentially moving said suction applicator heads relative to said separator disk during rotation of said suction applicator heads with said separator disk to sequentially pull portions of sheet material articles through the gaps in the separator disk.

3. An apparatus as set forth in claim 1 wherein each of said suction applicator heads moves with an engaged portion of a sheet material article relative to said hopper means during the application of suction to the engaged portion of the sheet material article.

4. An apparatus as set forth in claim 1 wherein said separator means includes drive means for moving one of said suction applicator heads into a space between a lowermost sheet material article in the stack and a sheet material article being fed from said hopper means by said feed means.

5. An apparatus as set forth in claim 1 further including drive means for rotating said separator disk and suction applicator heads together about a first axis and means for moving said suction applicator heads relative to said separator disk while said separator disk and suction applicator heads are being rotated together about said first axis.

6. An apparatus for use in handling sheet material articles, said apparatus comprising hopper means for supporting a stack of sheet material articles, feed means for sequentially pulling sheet material articles from said hopper means, and separator means for sequentially separating an edge portion of a sheet material article in said hopper means from a next succeeding sheet material article in said hopper means while a preceding sheet material article is being pulled from said hopper by said feed means, said separator means including a rotatable separator disk and a suction applicator which rotates with said separator disk and applies suction to a portion of a sheet material article in said hopper means while the preceding sheet material article is being pulled from said hopper means by said feed means.

7. An apparatus as set forth in claim 6 further including drive means for rotating said separator disk and suction applicator together to move said suction applicator and at least a portion of said separator disk in a space disposed between an upwardly facing side surface area of the preceding sheet material article and a downwardly facing side surface of a lowermost sheet material article in said hopper means while the preceding sheet material article is being pulled from said hopper by said feed means.

8. An apparatus as set forth in claim 6 wherein said separator disk has a circular rim portion, said suction applicator being effective to apply suction to a portion of a sheet material article at a location disposed radially inwardly of the rim portion of said separator disk.

9. An apparatus as set forth in claim 6 further including means for moving said suction applicator relative to said separator disk during rotation of said suction applicator with said separator disk to move a portion of a sheet material article to which suction is being applied by said suction applicator from a location above a plane containing an upper side surface area of said separator disk to location beneath the plane containing the upper side surface area of said separator disk while said separator disk and suction applicator are being rotated together.

10. An apparatus as set forth in claim 6 wherein said separator disk includes surface means for defining a plurality of gaps which extend axially through said separator disk, said suction applicator including a plurality of suction applicator heads each of which is aligned with one of said gaps in said separator disk.

11. A method for use in handling sheet material articles, said method comprising the steps of pulling a first sheet material article from a hopper, said step of pulling a first sheet material article from a hopper including sliding an upper side surface of the first sheet material article along a lower side surface of a second sheet material article disposed in the hopper, rotating a separator disk and a suction applicator head together about a central axis of the separator disk, and applying suction to a portion of the lower side surface of the second sheet material article with the suction applicator head while rotating the separator disk and suction applicator head together about the central axis of the separator disk and while sliding the upper side surface of the first sheet material article along the lower side surface of the second sheet material article.

12. A method as set forth in claim 11 further including the step of engaging an upper side surface of the second sheet material article with a lower side surface of the separator disk while rotating the separator disk and suction applicator head together about the central axis of the separator disk.

13. A method as set forth in claim 12 wherein said step of engaging an upper side surface of the second sheet material article with a lower side surface of the separator disk is at least partially performed while sliding the upper side surface of the first sheet material article along the lower side surface of the second sheet material article.

14. A method as set forth in claim 11 further including the step of moving the suction applicator head relative to the separator disk while rotating the separator disk and suction applicator head together about the central axis of the separator disk and while applying suction to a portion of the lower side surface of the second sheet material article with the suction applicator head to deflect the sheet material article to which suction is applied.

15. A method for use in handling sheet material articles, said method comprising the steps of rotating a plurality of suction applicator heads and a separator disk together about a central axis of the separator disk, applying suction to a lower side surface of a first sheet material article in a stack of sheet material articles with a first one of the suction applicator heads while performing said step of rotating the plurality of suction applicator heads and separator disk together, thereafter, engaging an upper side surface of the first sheet material article with a lower side surface of the separator disk while continuing to perform said step of rotating the plurality of suction applicator heads and separator disk together, thereafter, gripping an edge portion of the first sheet material article and pulling the first sheet material article from the stack of sheet material articles, applying suction to a lower side surface of a second sheet material article in the stack of sheet material articles with a second one of the suction applicator heads while performing said step of rotating the plurality of suction applicator heads and separator disk together, engaging the upper side surface of the second sheet material article with a lower side surface of the separator disk while continuing to perform said step of rotating the plurality of suction applicator heads and separator disk together, and thereafter, gripping an edge portion of the second sheet material article and pulling the second sheet material article from the stack of sheet material articles.

16. A method as set forth in claim 15 further including the steps of moving the first suction applicator head relative to the separator disk while performing said step of applying suction to a lower side surface of a first sheet material article and while performing said step of rotating the plurality of suction applicator heads and separator disk together, and moving the second suction applicator head relative to the separator disk while performing said step of applying suction to a lower side surface of a second sheet material article and while performing said step of rotating the plurality of suction applicator heads and separator disk together.

17. A method as set forth in claim 15 wherein said step of applying suction to a lower side surface of a second sheet material article in the stack of sheet material articles is initiated while performing said step of pulling the first sheet material article from the stack of sheet material articles.

18. A method as set forth in claim 17 wherein said step of engaging the upper side surface of the second sheet material article with a lower side surface of the separator disk is initiated while performing said step of pulling the first sheet material article from the stack of sheet material articles.

* * * * *